US009448028B2

(12) United States Patent
Panzanaro

(10) Patent No.: US 9,448,028 B2
(45) Date of Patent: Sep. 20, 2016

(54) SHOOTING STABILIZER FOR HAND-HELD PRECISION WEAPONS

(75) Inventor: Mauro Panzanaro, L'Aquila (IT)

(73) Assignee: TECNOLOGIA PER LA RICERCA AMBIENTE E SCUOLA SOCIETÁ COOPERATIVA, L'Aquila (IT)

( * ) Notice: Subject to any disclaimer, the term of this patent is extended or adjusted under 35 U.S.C. 154(b) by 69 days.

(21) Appl. No.: 14/008,629

(22) PCT Filed: Mar. 28, 2012

(86) PCT No.: PCT/IB2012/051480

§ 371 (c)(1),
(2), (4) Date: Sep. 30, 2013

(87) PCT Pub. No.: WO2012/131593

PCT Pub. Date: Oct. 4, 2012

(65) Prior Publication Data

US 2014/0013646 A1 Jan. 16, 2014

(30) Foreign Application Priority Data

Mar. 31, 2011 (IT) ..... AQ2011A0003

(51) Int. Cl.
*F41A 23/02* (2006.01)
*F41C 23/06* (2006.01)

(52) U.S. Cl.
CPC ..... *F41A 23/02* (2013.01); *F41C 23/06* (2013.01)

(58) Field of Classification Search
None
See application file for complete search history.

(56) References Cited

U.S. PATENT DOCUMENTS 1,088,362 A 2/1914 Perkins
2,669,325 A * 2/1954 Raines ..... 188/267
2,720,819 A * 10/1955 Ryan et al. ..... 89/43.01
3,208,179 A 9/1965 Hrebicek
3,387,538 A * 6/1968 Browning ..... 89/177
3,461,589 A * 8/1969 Vironda ..... F41C 23/06 42/1.06
4,663,877 A * 5/1987 Bragg ..... 42/74
6,668,478 B2 * 12/2003 Bergstrom ..... 42/1.06
8,176,668 B2 * 5/2012 Simms ..... F41C 23/08 42/1.06
2002/0178901 A1 * 12/2002 Bergstrom ..... F41B 11/64 89/198

(Continued)

FOREIGN PATENT DOCUMENTS

WO 2008/030128 3/2008

OTHER PUBLICATIONS

International Search Report for PCT/IB2012/051480, all pages mailed Jul. 25, 2012.

(Continued)

*Primary Examiner* — Stephen M Johnson
*Assistant Examiner* — Benjamin Gomberg
(74) *Attorney, Agent, or Firm* — Nixon & Vanderhye PC

(57) ABSTRACT

A stabilizer device (100) for a firearm, apt to control the movement performed by the firearm barrel (11) in the instant in which a bullet is ejected, comprising a support element (1) for the firearm barrel (11), removably fixed or fixable to the barrel (11) and apt to be made slidable along a main direction of extension of the barrel (11) with respect to the stock (13) of the firearm that can be gripped by a shooter, and control means for controlling the sliding motion of the support element (1) with respect to the stock (13) of the firearm, having a first (14; 140) and a second (15; 150) control element constrained or constrainable respectively to the support element (1) and to the stock (13) and apt to cooperate to limit and control the extent of such sliding.

7 Claims, 1 Drawing Sheet

(56) References Cited

U.S. PATENT DOCUMENTS

| | | | | |
|---|---|---|---|---|
| 2003/0154640 | A1 | 8/2003 | Bragg | |
| 2006/0048637 | A1* | 3/2006 | Dimitrios | F41A 3/86 89/14.3 |
| 2007/0199224 | A1* | 8/2007 | Bentley | 42/72 |
| 2010/0122482 | A1 | 5/2010 | Simms et al. | |
| 2011/0235346 | A1* | 9/2011 | Fridley | 362/398 |

OTHER PUBLICATIONS

Written Opinion for PCT/IB2012/051480, all pages, mailed Jul. 25, 2012.

International Preliminary Report on Patentability for PCT/IB2012/051480, all pages, mailed Jun. 18, 2013.

* cited by examiner

SHOOTING STABILIZER FOR HAND-HELD PRECISION WEAPONS

This application is the U.S. national phase of International Application No. PCT/182012/051480 filed 28 Mar. 2012 which designated the U.S. and claims priority to IT AQ2011A000003 filed 31 Mar. 2011, the entire contents of each of which are hereby incorporated by reference.

FIELD OF THE INVENTION

The present invention refers to a device for a firearm, in particular a stabilizer device enabling to increase shooting precision and reproducibility for small arms.

BACKGROUND OF THE INVENTION

In the use of precision weapons, e.g. in the use of rifles or handguns for wing or target shooting competitions, oft-times a remarkable training of the shooter is required in order to limit the effects of the deviation on bullet trajectory imposed by weapon movement at bullet ejection.

Such a movement, also known as recoil effect of firearms, is caused by gunpowder combustion gases which, by being able to expand only horizontally inside the firearm barrel, push the bullet toward the muzzle and the breech, and therefore the weapon itself, in the opposite direction.

Therefore, the effect of the recoil phenomenon influences the shooter's aim since the weapon moves at the same shooter's hand or shoulder.

In the state of the art there are numerous shock absorber devices for reducing the recoil of a firearm.

Document US2010/0122482, e.g., describes a recoil reducer device for firearm, device which is positioned inside two cavities, aligned therebetween, obtained respectively in a distal portion and in a proximal portion of the shoulder stock of a firearm.

The device comprises a shock absorber system comprised of a plurality of members, such as a piston, a spring, a magnetic element and iron plates, which overall enable the device to be moved between the rest position and the recoil position.

The change of position is carried out by means of a relative sliding of the sole proximal portion on the distal portion of the shoulder stock, and the magnetic element positioned inside the described device acts as return member, for the device itself, from the recoil position to the rest position.

A further anti-recoil device for firearms, substantially having a firing damping function, is described in WO2008/030128.

Also in document U.S. Pat. No. 3,208,179 a shock absorbing device for absorbing the shock of a firearm is described, comprising a coil spring, two pushing elements and two cams.

A drawback of known devices is that they have a remarkable encumbrance, oft-times requiring precision machining on the weapon which increase its production costs.

Moreover, those are devices which only partially reduce the phenomenon of deviation of bullet trajectory at ejection of the bullet itself from the firearm.

The above-mentioned devices are unable to oppose the thrust which barrel-contained gases exert on the bullet before the latter exits the barrel, thrust causing bullet deviations from the set direction of shooting.

Besides the impact on the shooter's grip, the recoil has an effect also on the positioning of the end portion of the barrel.

At the exiting of the bullet from the barrel, part of the energy due to recoil causes a rotation of the weapon about the bearing or grip point of the weapon itself, causing a climb of the muzzle.

Obviously this effect, also called bounce, depends on numerous characteristics, and is variable with the bullet speed and weight, the barrel length, the specific shape of the weapon, the weapon weight, the relative position of the grip with respect to the barrel, and with the same mode with which the weapon is gripped by the shooter.

Systems for reducing said phenomenon exist; e.g., there are rifles provided with a plurality of holes on the barrel surface, so as to cause a certain amount of gases to be conveyed therein to at least partially compensate for the phenomenon. The effectiveness of such a system is partial, and is anyhow linked to the size, number and specific positioning of the holes made on the barrel surface.

SUMMARY OF THE INVENTION

The present invention refers to a device enabling to increase shooting precision and reproducibility of small arms, e.g. of a precision rifle, by the use of a slide system with adjustable friction.

Precision rifles have to be light-weight, reliable under any climatic condition, and need to withstand many knocks without being cleaned and without loss of accuracy.

In this class of weapons it is possible to distinguish between actual precision rifles and rifles for support to first-line troops. For the former, precision is preferred over rate of fire, most of them therefore are hand-loading; for the latter instead, firing rate is more important and therefore they are self-loading.

Regardless of weapon operation, when the bullet leaves the barrel, gases contained in the barrel exert a thrust opposite to bullet movement. Actually, this movement starts before the bullet exits the barrel and causes small deviations from the set direction of shooting.

In light of these remarks, the parameters influencing shooting precision depend on weapon supports and the force the shooter applies on the same weapon.

Moreover, to guarantee a good precision it is necessary to attain a high reproducibility of the above-mentioned parameters during shooting.

For this reason, in order to improve his/her abilities, the shooter undergoes intense training, but the variability of the above-mentioned parameters is seriously influenced by external conditions and the shooter's stress.

In the use in sports disciplines, these weapon are normally built or prepared upon specific request by the shooter, such as to satisfy personal needs for attaining the utmost precision, in practice becoming not mere weapons anymore, but actual "shooting instruments" which, matched with specific ammunition prepared only for that specific weapon by the same shooter, today are able to produce a single hole on the target even after plural shots fired.

Cartridges are prepared by the same shooters with handcrafted, yet extremely sophisticated means, since commercial cartridges as a rule are not sufficiently precise to guarantee appreciable results in competitions.

Therefore, a first fundamental aspect of precision weapons, above all those used for sports competitions, is the ease of assembly and maintenance, those being directly carried out by the shooter.

A further and as important aspect to be considered in the construction of precision weapons used in sports competitions is cost containment.

In consideration of the above-described aspects, the technical problem set and solved by the present invention is to provide a device assisting the shooter is during the shooting, allowing him/her to have better performances, with no need to undergo intense training.

Such a problem is solved by a stabilizer device for the firing assembly of a precision weapon according to claim 1.

Preferred features of the present invention are the subject-matter of the dependent claims thereof.

In its broadest meaning, subject-matter of the invention is a stabilizer device which overcomes the above-mentioned problems by entrusting the control of backward movement of the weapon, subject to recoil during shooting, to, a mechanism which enables to attain a controlled and highly reproducible movement.

If the backward movement of the weapon is made constant so that the bullet leaves the barrel always with the same backward movement, an increase in shooting precision is attained.

The invention attains an increase of shooting precision with a >50% reduction in standard deviation.

The invention further enables a great versatility of use of the stabilizer device, which can be assembled in a universal shoulder stock in order to be adapted to all types of long- or short-barreled weapon, or can be adopted in a mass-produced weapon by modifying only the shoulder stock.

A further advantage of the present invention is the attainment of a desired shooting precision even in situations of high stress of the shooter.

Advantageously, moreover, the device according to the present invention allows exclusion thereof, and therefore the possibility for the shooter to switch, at any moment, to a traditional shooting mode.

Other advantages, features and the operation steps of the present invention will be made apparent in the following detailed description of some embodiments thereof, given by way of example and not for limitative purposes.

BRIEF DESCRIPTION OF THE FIGURES

Reference will be made to the figures of the annexed drawings, wherein.

DETAILED DESCRIPTION OF PREFERRED EMBODIMENTS

Figure 1:
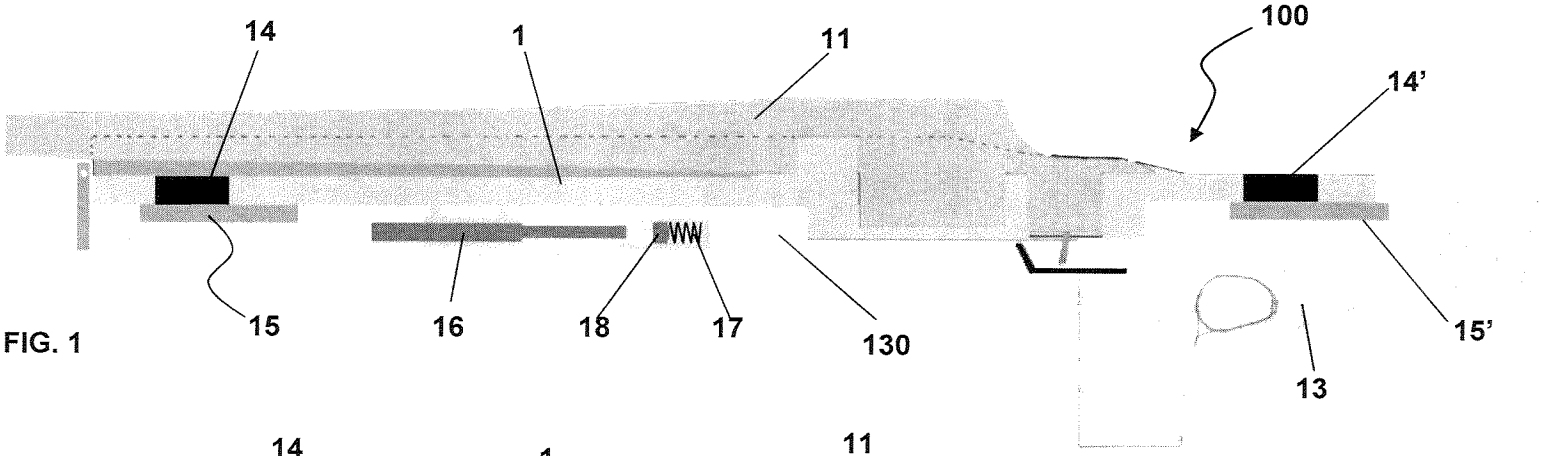
FIG. 1 shows a sectional view of a first preferred embodiment of the device (100) according to the present invention, in a configuration preceding the firing.

A first preferred embodiment of the present invention concerns a stabilizer device, as shown in FIG. 1, generally denoted by 100.

In particular, in FIG. 1 a first preferred embodiment of the invention is depicted, in a configuration preceding the shooting.

The stabilizer device 100 is apt to control, by reducing the deviations from the longitudinal axis of the barrel, the movement performed by the barrel 11 of the weapon in the instant in which a bullet travels through the barrel inside.

In the preferred embodiment described herein, the stabilizer device 100 comprises a support element 1 for the weapon barrel 11, removably fixed or fixable to the barrel 11 itself, e.g. by fixing screws.

The support element 1 is apt to be made slidable with respect to a firearm portion, denoted by the wording "stock" 13, which can be gripped by a shooter.

The relative moving of the support element 1 with respect to the stock 13 occurs along the main direction of extension of the barrel 11 of the firing assembly.

In particular, the above-mentioned relative moving can occur in both directions, e.g., with a maximum extension of about 3 cm.

Preferably, the relative sliding between the support element 1 and the stock 13 occurs by interposition of suitable guiding means, e.g. a slide guide.

In order to reduce to a minimum any friction phenomena during the above-mentioned sliding, the components interposed are preferably made of materials having low friction coefficients.

In particular, the slide guides of the system may be equipped with adjustment screws for side clearance control.

Alternatively to constant-section guides, the above-mentioned guide means comprises bearings, ball or roller ones, containing lubricating materials, e.g. scarcely sensitive to temperature drops, in order not to consistently influence the sliding force of the two parts.

Figure 2:
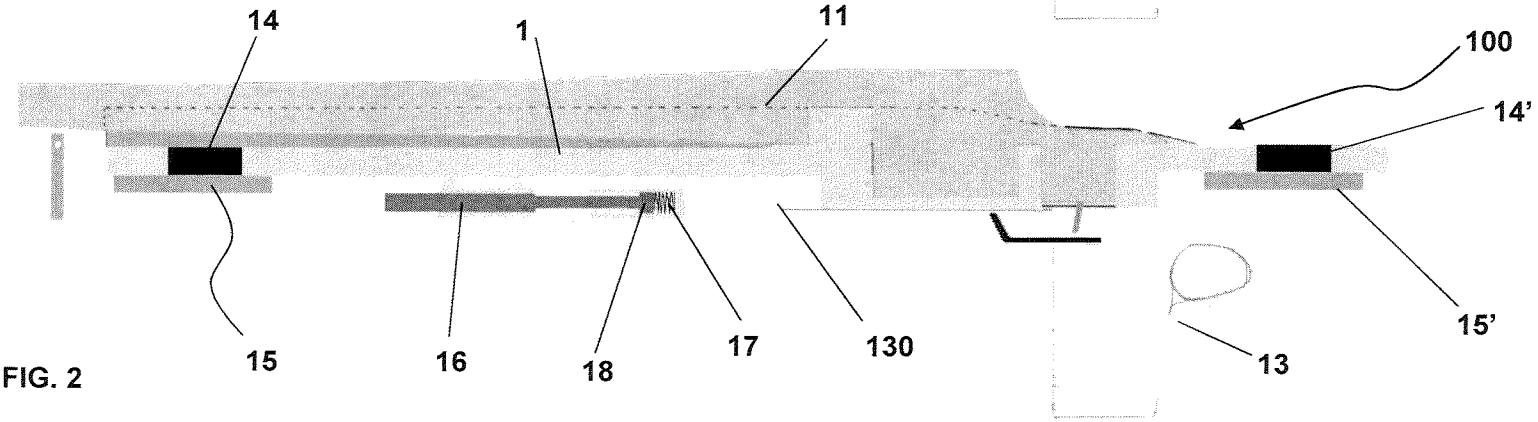
FIG. 2 shows a sectional view of a first preferred embodiment of the device (100) according to the present invention, in a configuration subsequent to the shooting.

As shown in FIGS. 1 and 2, the stabilizer device 100 further comprises control means for controlling the sliding motion of the support element 1 with respect to the stock 13 of the firearm.

Such control means comprises a first control element, e.g. a magnetic element 14, constrained or constrainable to the support element 1, and a second control element, e.g. a magnetic element 15, constrained or constrainable to the stock 13. Preferably, the second control element comprises an abutment plate 15, e.g. metallic.

The above-mentioned first and second control elements are apt to cooperate to limit the extent of the sliding of the support element 1 with respect to the stock 13 of the firearm. Preferably, as shown in FIG. 1, the second control element is positioned at a stock portion 130 extending below the barrel 11.

In an alternative version, not depicted, the above-mentioned control means comprises one of the two control elements comprised of an elastic element and mechanically coupled or couplable to the other one of the two control elements.

In particular, a first control element is provided, made of a suitably coated slider, constrained to the support element and pushed, through an adjustable spring, against an abutment surface, preferably plane, present on a stock portion 13.

In the preferred embodiment described herein, each abutment plate 15 is apt to be coupled to a respective magnetic element 14.

Moreover, the magnetic force generated by the coupling of the magnetic element 14 with the abutment plate 15 fosters a coupling between the support element and the stock portion 130.

In particular, the use of permanent magnets 14 ensures a greater reproducibility of the sliding, as their motion on conducting surfaces, such as, e.g., a metallic abutment plate 15, generates an opposite magnetic field whose intensity is proportional to the speed of the sliding itself.

This effect contributes to the reproducibility of the sliding motion between the two portions.

In particular, the use of the magnets 14 fosters a reproducibility of the shooting.

In the case of absence of the magnets 14, also the force caused by gas combustion before the bullet exits the barrel 11 discharges entirely on the shooter.

Thanks to the use of the magnets 14, interposed to guarantee a coupling between the support element 1 and the stock 13, the above-mentioned force causes a sliding between the two portions.

Said sliding will be regulated by the strength of the magnetic force, so as to guarantee a reproducibility of the bullet exiting mode from the barrel 11.

In other words, the extent of the sliding produced is such as to foster an exiting of the bullet from the barrel 11 at a same portion of the barrel 11 itself.

Therefore, a systematic error of the system is generated which can be compensated for at the weapon calibration stage.

Advantageously, the error due to shooter manuality is therefore reduced.

Moreover, the choice of using the magnets guarantees optimal functionality of the system, as it remarkably simplifies the mechanisms present therein.

Thus, it is possible to adjust the frictional force both under static and dynamic conditions.

An adjustment of the frictional force affects the force required to obtain the sliding of the support element 1 on the stock portion 13.

In particular, the magnetic force generated by the nearing of the magnetic element 14 to the abutment plate 15 is proportional to the relative distance between the two elements.

Therefore, an adjustment of said coupling force is envisaged by means of a variation of the distance between the magnetic element 14 and the abutment plate 15.

In particular, it is envisaged the use of means for adjusting a coupling force between the above-mentioned first and second control elements.

In the above-described alternative configuration, not depicted, a variation of the frictional force generated by the control means is carried out by suitably modulating the compression of the elastic element.

In general, in a coupling configuration of the control elements, the control means is apt to limit a sliding of the support element with respect to the stock portion 13.

The stabilizer device 100 is therefore configured to eliminate the rigid constraints, present in a conventional-type firearm, between the firing assembly, and in particular between the barrel, the action, the magazine and the sighting systems, and the stock.

Therefore, in a firearm use configuration, the stabilizer device 100 allows a greater shooting precision due to relative sliding between the support element and the portion 13 of the shoulder stock, such sliding being linked to the absorption of the so-called recoil force.

In fact, as depicted in FIG. 2, in a configuration subsequent to the shooting, the support element 1 is positioned in a configuration different with respect to the shooter's grip element 13.

Moreover, a positioning of the control means along the extension of the barrel 11 of the firearm, allows to oppose small deviations of the bullet from the set direction of shooting, and to stabilize the bullet trajectory inside the same barrel 11, before the bullet reaches the outlet mouth.

In particular, a suitable positioning of the control means in proximity of the outlet mouth of the barrel of the firearm allows absorbing, at least partially, the forces responsible for the bounce effect.

In order to guarantee the desired sliding between the support element 1 and the stock 13 of the firearm, the stabilizer device 100 further comprises a second pair of control elements 14' and 15', equivalent in shape and operation to those described above, positioned, in use, at a proximal portion of the firearm barrel 11.

In a further embodiment, not depicted, the positioning of a third pair of control elements is envisaged, preferably positioned at a median zone of the barrel 11 in order to further stabilize the bullet trajectory inside the same barrel 11, before the bullet reaches the outlet mouth.

In the preferred embodiment version, the stabilizer device 100 further comprises end-of-stroke means apt to limit a sliding of the support element 1 with respect to the stock 13 in a direction opposite to the bullet exiting one.

Such end-of-stroke means comprises a piston 16, in particular of adjustable length, preferably constrained to the support element.

In an operative step of shooting, in response to the recoil force, the support element 1 slides on the stock 13 in a direction opposite to that of the bullet.

The piston 16, which slides with the support element 1, abuts on a stopper, preferably constrained to the stock 13 so as to block an excessive sliding of the support element with respect to the stock 13.

Moreover, in the preferred embodiment described herein, the stabilizer device 100 comprises end-of-stroke damping means.

Preferably, the damping means comprises an elastic element 17 on which the above-mentioned piston 16 abuts.

To foster the damping effect, it is moreover envisaged the interposition of an abutment element 18 between the piston and the elastic element 17.

Alternatively to the elastic element 17, to damp the rear end-of stroke the use of a pneumatic, and/or hydraulic, and/or magnetic damper is envisaged.

In all embodiment versions described above it is envisaged the use of a sliding block, made by the inserting of a blocking element between the support element 1 and the stock 13, which is selectively operable and allows to use the weapon under original conditions.

Alternatively, a relative sliding between the support element 1 and the stock 13 of the firearm may be blocked by a fixing of the piston 16.

For instance, fixing elements cooperating with the piston 16 may be envisaged which, suitably adjusted, enable a fixing of the piston 16 itself, and therefore of the support element 11, with respect to the stock 13.

Moreover, a further aspect of the present invention concerns a precision firearm comprising the stabilizer device 100 as described above. In particular, a precision weapon having a stock which extends along the entire length of the firing assembly and is comprised of a bottom portion containing the shooter's grip points (shoulder, right hand and left hand), and a top portion firmly constrained to the firing assembly and slidably movable with respect to the first portion.

The present invention has hereto been described with reference to preferred embodiments thereof. It is understood that other embodiments might exist, all falling within the concept of the same invention, as defined by the protective scope of the claims hereinafter.

The invention claimed is:

1. A stabilizer device for a firearm, which is adapted to control the movement performed by a firearm barrel when a bullet is fired, comprising:

a support element for the firearm barrel, removably fixable to the barrel and adapted to be made slidable along a main direction of extension of the barrel with respect to a stock of the firearm that is adapted to be gripped by a shooter; and a controller for controlling the sliding motion of said support element with respect to the stock of the firearm, having a first pair of control elements adapted to cooperate to limit the extent of such sliding, wherein an overall configuration of the stabilizer device is such that said first pair of control elements are positioned and act, in use, only at a distal portion of the firearm barrel, said controller comprising a second pair of control elements, distinct and spaced apart from said first pair of control elements along said main direction of extension of the barrel, said second pair of control elements being positioned and acting, in use, only at a proximal portion of the firearm barrel;

wherein said first pair of control elements and said second pair of control elements are magnetically coupled or couplable magnetic elements; and wherein each of said first and said second pair of control elements is made by a first control element being a solid magnetic element constrainable to the support element and a second control element being a magnetic abutment plate constrainable to the stock, respectively.

2. The stabilizer device according to claim 1, further comprising an end-of-stroke element adapted to limit sliding of said support element with respect to the stock in a direction opposite to the bullet exiting direction.

3. The stabilizer device according to claim 1, further comprising a damper of the relative movement between said support element and the stock.

4. The stabilizer device according to claim 3, wherein said damper comprises an elastic element and a piston constrained to said support element and adapted to abut said elastic element.

5. The stabilizer device according to claim 3, wherein said damper comprises an elastic element and a piston constrained to said support element and adapted to abut said elastic element by interposition of an abutment element.

6. The stabilizer device according to claim 1, further comprising a blocking element, selectively operable to prevent sliding of said support element with respect to the stock.

7. A firearm comprising a stabilizer device according to claim 1.

* * * * *